US005114903A

United States Patent [19]

Dalebroux

[11] Patent Number: 5,114,903

[45] Date of Patent: May 19, 1992

[54] THERMALLY-RESPONSIVE RECORD MATERIAL

[75] Inventor: Dean G. Dalebroux, Green Bay, Wis.

[73] Assignee: Appleton Papers Inc., Appleton, Wis.

[21] Appl. No.: 789,716

[22] Filed: Nov. 8, 1991

[51] Int. Cl.[5] ..... B41M 5/30

[52] U.S. Cl. ..... 503/209; 427/151; 503/216; 503/225

[58] Field of Search ..... 427/151; 503/209, 216, 503/225

[56] References Cited

U.S. PATENT DOCUMENTS 3,671,543 6/1972 Koga et al. ..... 503/218

*Primary Examiner*—Pamela R. Schwartz

*Attorney, Agent, or Firm*—Benjamin Mieliulis

[57] ABSTRACT

A novel thermally-responsive record material is disclosed comprising a support having provided thereon in substantially contiguous relationship an electron donating dye precursor and a succinimide of the formula

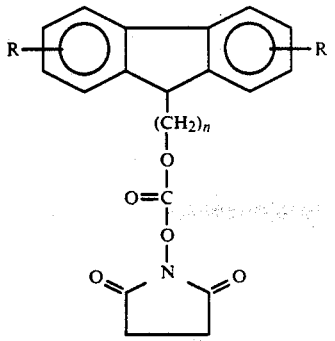

wherein n is an integer from 1 to 3 wherein each R is independently selected from hydrogen and $C_1$ to $C_8$ alkyl, and a suitable binder therefor.

The record material according to the invention when imaged resists fade when contacted with certain environmental challenges including oils, solvents, and elevated temperatures, all of which can be encountered in the environments of use of these record materials.

10 Claims, No Drawings

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material (electron-donating dye precursors) and acidic color developer material. This invention particularly concerns a thermally-responsive record material capable of forming a non-reversible image resistant to fade or erasure due to contact with oils, solvents or exposure to elevated temperature. The invention teaches a record material having improved image density retention.

2. Description of Related Art

Thermally responsive record material systems are well known in the art and are described in many patents, for example, U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal response, desirably producing a colored image of sufficient intensity upon selective thermal exposure.

A drawback of thermally-responsive record materials limiting utilization in certain environments and applications has been the undesirable tendency of thermally-responsive record materials upon forming an image to not retain that image in its original integrity over time when the thermally-responsive record material is handled or exposed to common liquids or oils or plasticizers such as found in skin oil, plastic food wrap, cooling oil and solvents such as common carbonless paper solvents. As a result, a high degree of care and control in handling imaged thermally-responsive record materials has been required. This loss of image density and fade can be not only annoying but potentially detrimental whenever the integrity of records is allowed to become suspect through improper record storage.

The ability of a thermally-responsive record material to resist image fading or erasure upon contact with common oils, solvents or plasticizers would be an advance in the art and of commercial significance.

It is an object of the present invention to disclose a thermally-responsive record material having improved image retention and resistance to fade or erasure. The record material of the invention is remarkably resistant to fade or erasure when contacted with common oils, such as skin oil, internal phase carbonless solvents, or plasticizers.

It is an object of the present invention to disclose a thermally-responsive record material comprising a support member bearing a thermally-sensitive color forming composition comprising chromogenic material and acidic developer material in substantially contiguous relationship, whereby the melting or sublimation of either material produces a change in color by reaction between the two, and a suitable binder therefor.

DETAILED DESCRIPTION

The present invention is a novel thermally-responsive record material bearing a thermally-sensitive color-forming composition comprising a chromogenic material, and a succinimide of the formula

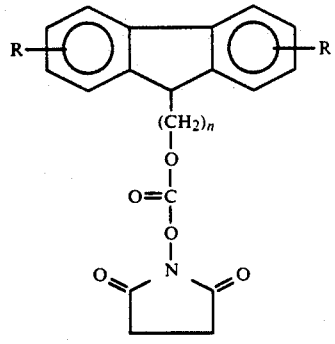

(I)

wherein n is an integer from 1 to 3 wherein each R is independently selected from hydrogen or $C_1$–$C_8$ alkyl.

The succinimide is an acidic developer material and is in substantially in contiguous relationship with the chromogenic material whereby the melting, softening, or sublimation of either material produces a change in color by reaction between the two.

Succinimides, according to the invention, include N-(9-fluorenylmethoxycarbonyloxy) succinimide, N-(9-(3,6-dimethylfluorenyl)methoxycarbonyl) succinimide, N-(9-fluorenylethoxy carbonyloxy) succinimide, N-(9-(3,6-dimethylfluorenyl) ethoxycarbonyl) succinimide, N-(9-(3,6-dibutylfluorenyl) ethoxycarbonyl) succinimide, N-(9-fluorenylisopropoxy-carbonyloxy) succinimide, and N-(9-fluorenylpropoxycarbonyloxy) succinimide. Most preferred is N-(9-fluorenylmethoxycarbonyloxy) succinimide. This succinimide has the structure

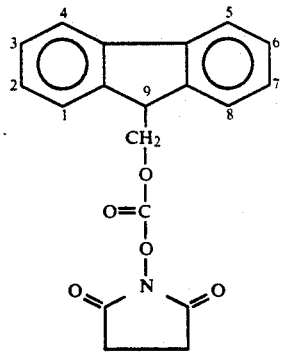

The thermally responsive record materials containing the above succinimide are characterized by developing a thermal image that is resistant to erasure due to contact with oils, solvents and exposure to elevated temperatures, all of which may be encountered in normal office environments.

In addition to the chromogen and succinimide, other materials such as sensitizers, fillers, antioxidants, lubricants, waxes and brighteners optionally may be added if desired.

The thermally-responsive record material of the invention has the unexpected and remarkable properties of being capable of forming a non-reversible high density image upon selective thermal contact and of retaining that image over time when handled or exposed to common skin oils, internal phase carbonless solvents, and plasticizers. This remarkable ability of the succinimides to impart fade and erasure resistance is a significant advance in the art.

The present invention is a novel thermally-responsive record material comprising a support having provided thereon in substantially contiguous relationship an electron donating dye precursor, the succinimide of Formula (I) as the electron accepting developer compound, and a suitable binder therefor.

The invention also comprises in a more preferred embodiment a thermally-sensitive color-forming composition comprising chromogenic material, the succinimide of Formula I, an acidic developer material, and binder material. The unexpected feature of this composition is that, the inclusion of the above succinimide with prior art thermally-sensitive color-forming compositions results in a composition possessing improved resistance to fade and image erasure.

The record material according to the invention has a non-reversible image in that it is non-reversible under the action of heat. The coating of the record material of the invention is basically a dewatered solid at ambient temperature.

The color-forming system of the record material of this invention comprises electron donating dye precursors, also known as chromogenic material, in its substantially colorless or light-colored state and the succinimide according to Formula (I) optionally but preferably together with acidic developer material. The color-forming system relies upon melting, softening, or subliming one or more of the components to achieve reactive, color-producing contact with the chromogen.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical.

The components of the color-forming system are in substantially contiguous relationship, substantially homogeneously distributed throughout the coated layer material deposited on the substrate. The term substantially contiguous is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components positioned in a subsequent layer or layers. All such arrangements are understood herein as being substantially contiguous.

In manufacturing the record material, a coating composition is prepared which includes a fine dispersion of the components of the color-forming system, binder material preferably polymeric binder such as polyvinyl alcohol, surface active agents and other additives in an aqueous coating medium. The composition can additionally contain inert pigments, such as clay, talc, silicon dioxide, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, sensitizers and antioxidants. Sensitizers, for example, can include acetoacet-o-toluidine, phenyl-1-hydroxy-2-naphthoate, 1,2-diphenoxyethane, and p-benzylbiphenyl. Use of sensitizer, specifically material such as 1,2-diphenoxyethane is preferred in all record system combinations herein. The sensitizer typically does not impact any image on its own but as a relatively low melt point solid, acts as a solvent to facilitate reaction between the mark-forming components of the color-forming system.

The color-forming system components are substantially insoluble in the dispersion vehicle (preferably water) and are ground to an individual average particle size of less than 10 microns, preferably less than 3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible electron donating dye precursors are chromogenic compounds, such as the phthalide, leucauramine and fluoran compounds, for use in the color forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spiro- dipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are:

3-diethylamino-6-methyl-7-anilino-fluoran (U.S. Pat. No., 3,681,390); 2-anilino-3-methyl-6-dibutylamino-fluoran (U.S. Pat. No. 4,510,513) also known as
3-dibutylamino-6-methyl-7-anilino-fluoran;
3-dibutylamino-7-(2-chloroanilino)fluoran;
3-(N-ethyl-N-tetrahydrofurfurylamino)-6-methyl-7-3,5'6-tris(di methylamino)spiro[9H-fluorene-9,1'(3'H)-isobenzofuran]-3'-one; 7-(1-ethyl-2-methylindol-3-yl)-7-(4-diethylamino-2-ethoxypheny 1) -5,7-dihydrofuro[3,4-b]pyridin-5-one (U.S. Pat. No. 4,246,318); 3-diethylamino-7-(2-chloroanilino)-fluoran (U.S. Pat. No. 3,920,510);
3-(N-methylcyclohexylamino)-6-methyl-7-anilino-fluoran (U.S. Pat. No. 3,959,571); 7-(1-octyl-2-methylindol-3-yl)-7-(4-diethylamino-2-ethoxyphenyl) -5,7-dihydrofuro[3,4-b] pyridin-5-one; 3-diethylamino-7,8-benzofluoran;
3,3-bis(1-ethyl-2-methylindol-3-yl)phthalide;
3-diethylamino-7-anilinofluoran; 3-diethylamino-7-benzylaminofluoran; 3'-phenyl-7-dibenzylamino-2,2'-spiro-di-[2H-1-benzopyran] and mixtures of any of the following.

The succinimide materials of the invention are acidic developer materials. The succinimide developers can be used alone or preferably in combination with any of the known acidic developer materials for record systems.

Examples of such other eligible acidic developer material which can be used in combination with the succinimide of the invention include the compounds listed in U.S. Pat. No. 3,539,375 as phenolic reactive material, particularly the monophenols and diphenols. Other eligible acidic developer material which can be used in such combination also include, without being considered as limiting, the following compounds:
4,4'-isopropylidinediphenol (Bisphenol A);
p-hydroxybenzaldehyde; p-hydroxybenzophenone;
p-hydroxypropiophenone; 2,4-dihydroxybenzophenone;
1,1-bis(4-hydroxyphenyl)cyclohexane; salicyanilide;
4-hydroxy-2-methylacetophenone; 2-acetylbenzoic acid;
m-hydroxyacetanilide; p-hydroxyacetanilide;
2,4-dihydroxyacetophenone; 4-hydroxy-4'-methylbenzophenone;
4,4'-dihydroxybenzophenone; 2,2-bis(4-hydroxyphenyl)-4-methylpentane; benzyl 4-hydroxy- phenyl ketone;
2,2-bis(4-hydroxyphenyl)-5-methylhexane;
ethyl-4,4-bis(4-hydroxyphenyl)-pentanoate;
isopropyl-4,4-bis(4-hydroxyphenyl)pentanoate;
methyl-4,4-bis(4-hydroxyphenyl)pentanoate;
allyl-4,4-bis(4-hydroxyphenyl)pentanoate;
3,3-bis(4-hydroxyphenyl)-pentane;
4,4-bis(4-hydroxyphenyl)-heptane; 2,2-bis(4-hydroxyphenyl)-1-phenylpropane; 2,2-bis(4-hydroxyphenyl)-butane;
2,2'-methylene-bis(4-ethyl-6-tertiarybutyl phenol); 4-hydroxycoumarin; 7-hydroxy-4-methylcoumarin; 2,2'-methylene-bis(4-octylphenol); 4,4'-sulfonyldiphenol; 4,4'-thiobis(6-tertiarybutyl-m-cresol); methyl-p-hydroxybenzoate;
n-propyl-p-hydroxybenzoate; benzyl-p-hydroxybenzoate.

Preferred among these are the phenolic developer compounds. More preferred among the phenol compounds are
4,4'-isopropylidinediphenol,
ethyl-4,4-bis(4-hydroxyphenyl)-pentanoate,
n-propyl-4,4-bis(4-hydroxyphenyl)pentanoate,
isopropyl-4,4-bis(4-hydroxyphenyl)pentanoate,
methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, and
benzyl-p-hydroxybenzoate. Acid compounds of other kind and types are eligible.

Use of the succinimide of Formula I, together with 2,2-bis(4-hydroxyphenyl)-4-methyl pentane was preferred. N-(9-fluorenylmethoxy-carbonyloxy) succinimide together with 4,4'-isopropopylidinediphenol was preferred.

Examples of other eligible acidic developer compounds for use with the succinimide of Formula I are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The succinimides of Formula I are functional as the acidic developer material when such succinimides are used alone but are preferred used in combination with the above-described acidic developer materials.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of less than 10 microns was achieved. The milling was accomplished in an attritor or other suitable milling device. The desired average particle size was less than 3 microns in each dispersion.

The thermally-responsive sheets were made by making separate dispersions of chromogenic material, sensitizer material, succinimide and/or other acidic developer material. The dispersions were mixed in the desired ratios and applied to a support with a wire wound rod and dried. Other materials such as fillers, antioxidants, lubricants and waxes can be added if desired. The sheets may be calendered to improve smoothness.

The thermal performance of the sheet is measured by imaging the sheet on a dynamic thermal test device, in this case an *Atlantek Thermal Response Tester,* Model 200. The thermal testing unit images the sheet with a thermal printhead, using a constant power voltage, a constant cycle time, and a sequentially increasing dot pulse duration resulting in a series of thermal images of increasing intensity. The thermal images are measured using a MacBeth RD-922 densitometer. The densitometer is calibrated such that 0.05 indicates pure white and 1.79 a fully saturated black image.

Resistance to image intensity decline upon exposure to elevated temperature is measured by placing a dynamically imaged sheet in a 60° C. oven for a period of 24 hours. The image intensity is measured both before and after this exposure period.

Resistance to image erasure due to contact with skin oil is done by applying a fingerprint (10 second contact) to a thermally imaged portion of the sheet. The image intensity is measured before fingerprint contact then again 10 days after fingerprint contact with the MacBeth RD-922 densitometer.

Resistance to image erasure due to contact with carbonless paper internal phase solvent is determined by applying a small amount of the internal phase solvent to an imaged area with a cotton swab. Image intensities are recorded both before and after the 10 day exposure period as described above.

| Dispersions | Parts |
|---|---|
| Dispersion A - Chromogenic material | |
| Chromogenic material | 34.6 |
| Binder, 20% solution of polyvinyl alcohol (Vinol 205) in water | 29.5 |
| Defoaming and dispersing agents | 0.5 |
| Water | 35.4 |
| TOTAL | 100.0 |
| Dispersion A-1 - Chromogenic material is N-102, 3-diethylamino-6-methyl-7-anilinofluoran. | |
| Dispersion B - Acidic material | |
| Acidic material | 34.0 |
| Binder, 20% solution of polyvinyl alcohol (Vinol 203) in water | 20.7 |
| Defoaming and dispersing agents | 0.2 |
| Water | 45.1 |
| TOTAL | 100.0 |
| Dispersion B-1 - Acidic material is AP-5, 2,2-bis(4-hydroxyphenyl)-4-methyl pentane. | |
| Dispersion C - Sensitizing material | |
| Sensitizing material | 34.0 |
| Binder, 20% solution of polyvinyl alcohol (Vinol 203) in water | 20.7 |
| Defoaming and dispersing agents | 0.2 |
| Water | 45.1 |
| TOTAL | 100.0 |
| Dispersion C-1 - Sensitizing material is DPE, 1,2-diphenoxyethane. | |
| Dispersion D - Pigment dispersion | |
| Zeosyl 200 (silicon dioxide) | 11.4 |
| Pergopak M-2 at 70% solids (urea-formaldehyde resin) | 7.5 |
| Resisto-Coat 135 at 35% Solids (paraffin wax emulsion) | 4.0 |
| Defoaming and dispersing agents | 0.1 |
| Binder, 20% solution of polyvinyl alcohol (Vinol 203) in water | 3.4 |
| Water | 73.6 |
| TOTAL | 100.0 |
| Dispersion E - Additive material | |
| Additive material | 17.0 |
| Binder, 28% solution of polyvinyl alcohol (Vinol 203) in water | 10.4 |
| Defoaming and dispersing agents | 0.1 |
| Water | 72.5 |
| TOTAL | 100.0 |
| Dispersion E-1 - Additive material is N-(9-fluorenylmethoxycarbonyloxy)succinimide. | |

Water soluble polymers other than polyvinyl alcohol may be used to prepare the dispersions.

The chromogenic, acidic, sensitizing and filler materials listed are illustrative and not intended to be limiting.

| Examples | Parts |
|---|---|
| Example 1 - Control | |
| Dispersion A-1 (N-102) | 3.80 |
| Dispersion B-1 (AP-5) | 7.04 |

-continued

| Examples | Parts |
|---|---|
| Dispersion C-1 (DPE) | 7.04 |
| Dispersion D (Pigment) | 12.96 |
| Zinc stearate emulsion at 32% solids | 2.40 |
| Methylol stearamide wax emulsion at 23% solids | 3.72 |
| Binder, 10% solution of methyl cellulose in water | 1.08 |
| Binder, 10% solution of polyvinyl alcohol in water | 6.76 |
| Water | 55.20 |
| TOTAL | 100.00 |
| Example 2 - 2% N-(9-fluorenylmethoxycarbonyloxy)succinimide. [in the table. for convenience, referred to as "fluorenyl succinimide"] | |
| Dispersion A-1 (N-102) | 3.80 |
| Dispersion B-1 (AP-5) | 7.04 |
| Dispersion C-1 (DPE) | 7.04 |
| Dispersion D (Pigment) | 11.64 |
| Dispersion E-1 (Fluorene succinimide compound) | 1.40 |
| Zinc stearate emulsion at 32% solids | 2.40 |
| Methylol stearamide wax emulsion at 23% solids | 3.72 |
| Binder, 10% solution of methyl cellulose in water | 1.08 |
| Binder, 10% solution of polyvinyl alcohol in water | 6.44 |
| Water | 55.44 |
| TOTAL | 100.00 |
| Example 3 - 5% N-(9-fluorenylmethoxycarbonyloxy)succinimide. | |
| Dispersion A-1 (N-102) | 3.80 |
| Dispersion B-1 (AP-5) | 7.04 |
| Dispersion C-1 (DPE) | 7.04 |
| Dispersion D (Pigment) | 9.64 |
| Dispersion E-1 (Fluorene succinimide compound) | 3.52 |
| Zinc stearate emulsion at 32% solids | 2.40 |
| Methylol stearamide wax emulsion at 23% solids | 3.72 |
| Binder, 10% solution of methyl cellulose in water | 1.08 |
| Binder, 10% solution of polyvinyl alcohol in water | 6.04 |
| Water | 55.72 |
| TOTAL | 100.00 |
| Example 4 - 10% N-(9-fluorenylmethoxycarbonyloxy)succinimide. | |
| Dispersion A-1 (N-102) | 3.80 |
| Dispersion B-1 (AP-5) | 7.04 |
| Dispersion C-1 (DPE) | 7.04 |
| Dispersion D (Pigment) | 6.00 |
| Dispersion E-1 (Fluorene succinimide compound) | 7.04 |
| Zinc stearate emulsion at 32% solids | 2.40 |
| Methylol stearamide wax emulsion at 23% solids | 3.72 |
| Binder, 10% solution of methyl cellulose in water | 1.08 |
| Binder, 10% solution of polyvinyl alcohol in water | 5.64 |
| Water | 56.24 |
| TOTAL | 100.00 |

TABLE 1

Dynamic Response/MacBeth Intensity

| Pulse Width (msec) | Example 1 (Control) | Example 2 (2% Fluorenyl Succinimide) | Example 3 (5% Fluorenyl Succinimide) | Example 4 (10% Fluorenyl Succinimide) |
|---|---|---|---|---|
| 1.0 | 1.43 | 1.41 | 1.40 | 1.39 |
| 0.9 | 1.44 | 1.43 | 1.41 | 1.38 |
| 0.8 | 1.45 | 1.43 | 1.40 | 1.37 |
| 0.7 | 1.44 | 1.42 | 1.39 | 1.35 |
| 0.6 | 1.40 | 1.37 | 1.34 | 1.28 |
| 0.5 | 1.23 | 1.23 | 1.16 | 1.13 |
| 0.4 | 0.82 | 0.80 | 0.76 | 0.74 |
| 0.3 | 0.32 | 0.30 | 0.27 | 0.27 |
| 0.2 | 0.12 | 0.10 | 0.11 | 0.09 |
| 0.1 | 0.11 | 0.09 | 0.09 | 0.08 |

TABLE 2

Percent Loss of Image Intensity After 24 Hours at 60° C.

| Pulse Width (msec) | Example 1 (Control) | Example 2 (2% Fluorenyl Succinimide) | Example 3 (5% Fluorenyl Succinimide) | Example 4 (10% Fluorenyl Succinimide) |
|---|---|---|---|---|
| 1.0 | 5.6 | 4.3 | 5.7 | 5.8 |
| 0.9 | 5.6 | 4.9 | 5.6 | 5.1 |
| 0.8 | 9.0 | 4.9 | 5.7 | 4.4 |
| 0.7 | 14.6 | 7.0 | 7.9 | 4.4 |
| 0.6 | 32.1 | 16.8 | 14.9 | 10.2 |
| 0.5 | 49.6 | 31.7 | 28.4 | 23.9 |
| 0.4 | 63.4 | 55.0 | 53.9 | 50.0 |
| 0.3 | 62.5 | 60.0 | 59.2 | 59.3 |
| 0.2 | — | — | — | — |
| 0.1 | — | — | — | — |

TABLE 3

Percent Image Loss Due to Skin Oil Contact (10 Day Exposure)

| | Percent Image Loss |
|---|---|
| Example 1 (Control) | 55.8 |
| Example 2 (2% Fluorenyl Succinimide) | 7.4 |
| Example 3 (5% Fluorenyl Succinimide) | 5.4 |
| Example 4 (10% Fluorenyl Succinimide) | 2.8 |

TABLE 4

Percent Image Loss Due to Carbonless IP Solvent Contact (10 Day Exposure)

| | Percent Image Loss |
|---|---|
| Example 1 (Control) | 92.0 |
| Example 2 (2% Fluorenyl Succinimide) | 60.3 |
| Example 3 (5% Fluorenyl Succinimide) | 34.2 |
| Example 4 (10% Fluorenyl Succinimide) | 20.0 |

What is claimed is:

1. A thermally-responsive record material comprising a support having provided thereon in substantially contiguous relationship an electron donating dye precursor, a succinimide of the formula

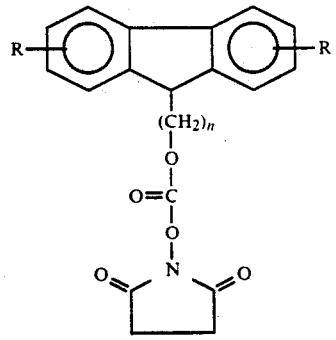

wherein n is an integer from 1 to 3 wherein each R is independently selected from hydrogen and $C_1$ to $C_8$ alkyl, and a suitable binder therefor.

2. The record material according to claim wherein the succinimide is N-(9-fluorenylmethoxycarbonyloxy) succinimide.

3. The record material according to claim 1 wherein the succinimide is N-(9-fluorenylisopropoxycarbonyloxy) succinimide.

4. The record material according to claim 1 wherin the succinimide is N-(9-(3,6-dimethyfluorenyl)methoxycarbonyl) succinimide.

5. The record material according to claim 1 including an additional color developer.

6. The record material according to claim 5 wherin the electronaccepting color developer is selected from 4,4'-isopropylidenediphenol and 2,2-bis(4-hydroxyphenyl)-4-methylpentane.

7. A thermally-responsive record material comprising a support having provided thereon in substantially contiguous relationship an electron-donating dye precursor, a succinimide of the formula

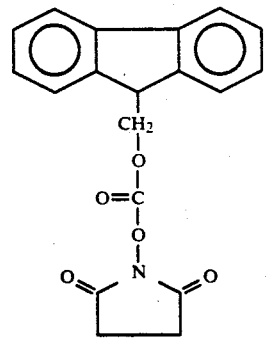

a sensitizer, and a suitable binder therefor.

8. The record material according to claim 7 wherein the sensitizer is selected from acetoacet-o-toluidine, phenyl-1-hydroxy-2-naphthoate, 1,2-diphenoxyethane, and p-benzylbiphenyl.

9. The record material according to claim 7 including an additional color developer.

10. The record material according to claim 7 wherein the electron-accepting color developer is selected from 4,4-isopropylidenediphenol and 2,2-bis(4-hydroxyphenyl)-4-methylpentane.

* * * * *